United States Patent [19]

LaBarge

[11] Patent Number: 4,928,844

[45] Date of Patent: May 29, 1990

[54] PRESSURE RELEASE FOR CARBONATED BEVERAGE CONTAINERS

[75] Inventor: Robert L. LaBarge, Ben Avon Borough, Pa.

[73] Assignee: Aluminum Company of America, Pittsburgh, Pa.

[21] Appl. No.: 338,311

[22] Filed: Apr. 14, 1989

[51] Int. Cl.[5] ..... B65D 51/16

[52] U.S. Cl. ..... 220/207; 220/89 A; 222/397

[58] Field of Search ..... 220/207, 367, 89 A; 215/260; 222/397; 137/68.1; 429/56

[56] References Cited

U.S. PATENT DOCUMENTS

| | | | |
|---|---|---|---|
| 3,724,727 | 4/1973 | Zundel | 222/397 |
| 3,807,597 | 4/1974 | Wells et al. | 220/48 |
| 3,831,822 | 8/1974 | Zundel | 222/397 |
| 3,850,339 | 11/1974 | Kinkel | 220/89 A |
| 3,902,626 | 9/1975 | Jordan et al. | 220/268 |
| 3,912,114 | 10/1975 | Morran et al. | 220/268 |
| 3,918,610 | 11/1975 | Willis | 222/397 |
| 3,929,251 | 12/1975 | Urmston | 220/268 |
| 3,938,455 | 2/1976 | Urmston | 113/121 |
| 3,946,683 | 3/1976 | Jordan | 113/15 |
| 3,977,341 | 8/1976 | Jordan et al. | 113/15 |
| 3,997,076 | 12/1976 | Jordan | 220/268 |
| 4,003,505 | 1/1977 | Hardt | 222/397 |
| 4,024,981 | 5/1977 | Brown | 220/269 |
| 4,039,101 | 8/1977 | Wells | 220/269 |
| 4,148,410 | 4/1979 | Brown | 220/269 |
| 4,484,691 | 11/1984 | Lees | 220/89 A |
| 4,513,874 | 4/1985 | Mulawski | 220/89 A |
| 4,580,692 | 4/1986 | La Barge et al. | 220/240 |
| 4,588,101 | 5/1986 | Reugg | 220/89 A |
| 4,610,370 | 9/1986 | Patterson et al. | 220/207 |
| 4,648,528 | 3/1987 | La Barge et al. | 220/240 |
| 4,673,099 | 6/1987 | Wells | 220/269 |
| 4,678,096 | 7/1987 | La Barge et al. | 220/273 |
| 4,685,849 | 8/1987 | La Barge et al. | 413/22 |
| 4,698,282 | 10/1987 | Mantello | 429/56 |
| 4,721,224 | 1/1988 | Kawabata | 220/89 A |
| 4,783,985 | 11/1988 | La Barge et al. | 72/379 |
| 4,789,608 | 12/1988 | Oswald | 429/56 |
| 4,793,510 | 12/1988 | Arfert et al. | 220/306 |

*Primary Examiner*—Stephen Marcus
*Assistant Examiner*—Nova Stucker
*Attorney, Agent, or Firm*—David W. Brownlee; Robert E. Isner

[57] ABSTRACT

This invention relates to an improved can end construction for carbonated beverage cans having a score line defined opening panel therein for beverage dispensing and, more particularly, to can ends for such type cans wherein said panel is incorporated in a selectively contoured spout configuration for accommodation of a resealing cap assembly engageable therewith.

15 Claims, 3 Drawing Sheets

PRESSURE RELEASE FOR CARBONATED BEVERAGE CONTAINERS

BACKGROUND OF THE INVENTION

Recent years have witnessed ever increasing quantities of carbonated beverages, such as beer and carbonated soft drinks, being packaged in amounts up to 12 ounces in metal cans and particularly in metal cans with ends that include a score line defined opening panel therein to provide implement free access to the contents. Such opening panel containing can ends are generally called "easy open ends" and include variant basic constructions of a first type wherein the score line completely circumscribes the panel to render the panel completely separable from the can end and of a second type wherein the score line only partially circumscribes the panel to render the latter only partially severable from the can end and to thus remain in attached relation within the can end after the pouring opening has been formed. As mentioned above, such opening panels are conventionally perimetrically delineated by score lines of decreased metal thickness.

In order to extend the use of such easy open can end constructions to larger volume containers, the art has suggested the utilization of a cap assembly to close and reseal the opening defined by such score line defined panel. Among the objects of such cap utilization are a re-closure of the container to prevent loss of liquid content and resealing of the container to limit further losses of the dissociable gases, i.e., the "carbonation", in the remaining liquid contents. U.S. Pat. No. 4,580,692 discloses one construction for such a resealable closure cap assembly in association with a selectively contoured can end construction to cooperatively accommodate such resealable closure and to retain the advantages characteristic of the "easy open end" construction.

The provision of commercially acceptable resealable easy open can end constructions for larger capacity beverage containers requires, in addition to the functional features of present easy open can ends, both sealable retention of the can contents and accommodation by the resealed cap of the inherent pressure buildup therein. Also required is a can end configuration at the pouring opening to accommodate the disposition of a resealing cap in operative relation thereto without appreciable diminution of the convenience and cost effective nature of the basic easy open end constructions during manufacturing, filling, shipping, selling, and consumer usage. As such, the provision of a commercially acceptable resealable easy open end construction requires accommodation of problems not heretofore met in the basic easy open end constructions conventionally employed in the smaller capacity beverage cans.

Experience to date with the resealable cap and can end construction disclosed in U.S. Pat. Nos. 4,580,692 and 4,648,528, the disclosure contents of which are herein generally incorporated by reference, has indicated that eventual failure of the can end due to excessive internal pressure therein may result in rupture of the score line defining the opening panel in the pouring spout. This locus of failure is quite different from that of conventional easy open can end constructions, where, under excessive internal pressure, the end usually ruptures in the vicinity of the peripheral countersink when the countersink inverts. The current industry standard requires that the can end be of such character as to accommodate an internal pressure of 93 psi before the initiation of countersink buckling.

SUMMARY OF THE INVENTION

This invention may be briefly described as an improved easy open can end construction that includes pressure responsive venting means operative to preclude rupture of the score line defining the opening panel under excessive internal pressure conditions. In its broader aspects, the invention includes an auxiliary pressure sensitive score line defining a deformation inducible fracture line disposed adjacent to the peripheral can end countersink and an intentional buckle inducing deformation of the countersink wall area immediately adjacent thereto to promote localized buckling and a concomitant concentration of score line fracture inducing forces thereat. In a narrower aspect, the invention includes the disposition of an auxiliary pressure sensitive and fracture defining score line intermediate a pair of buckle inducing deformations of the countersink defining wall and adjacent main body portion of the can end. In a still narrower aspect, the invention includes the sensitive disposition of the auxiliary pressure sensitive score line remote from a score line defined opening panel and in generally concentric adjacent relation to a rivet attaching a resealable cap to the can end.

Among the advantages of the subject invention is the provision of a pressure release vent assembly for easy open can ends that effectively precludes rupture of the score line defining the opening panel under excessive internal pressures. Further advantages include a pressure responsive safety venting system for resealable easy open ends that insures excessive pressure responsive rupture of the can end at locations remote from the opening panel at a controllable internal pressure level below that which would rupture the score line defining the opening panel. Still further advantages of the subject invention is the provision of a failure mode simply by fracture of an auxiliary score line with a consequent release of internal pressure that creates neither real nor perceived safety hazards.

The object of this invention is the provision of an improved pressure release venting system for easy open can ends.

A further object of the invention is the provision of an improved pressure release venting system for resealable easy open can ends and particularly for the resealable easy open can end construction disclosed in U.S. Pat. No. 4,580,692.

Further objects of this invention include the provision of a safety venting system for carbonated beverage containers for relief of internal pressure buildup therein that creates neither real nor perceived safety hazards and which is adapted for fabrication by the same equipment currently employed for fabrication of easy open can closures.

Other objects and advantages of the invention will become apparent from the following portions of this specification and from the appended drawings which illustrate, in accord with the mandate of the patent statutes, a presently preferred embodiment of a can end construction that incorporates the principles of this invention.

DETAILED DESCRIPTION OF THE INVENTION

Figure 1:
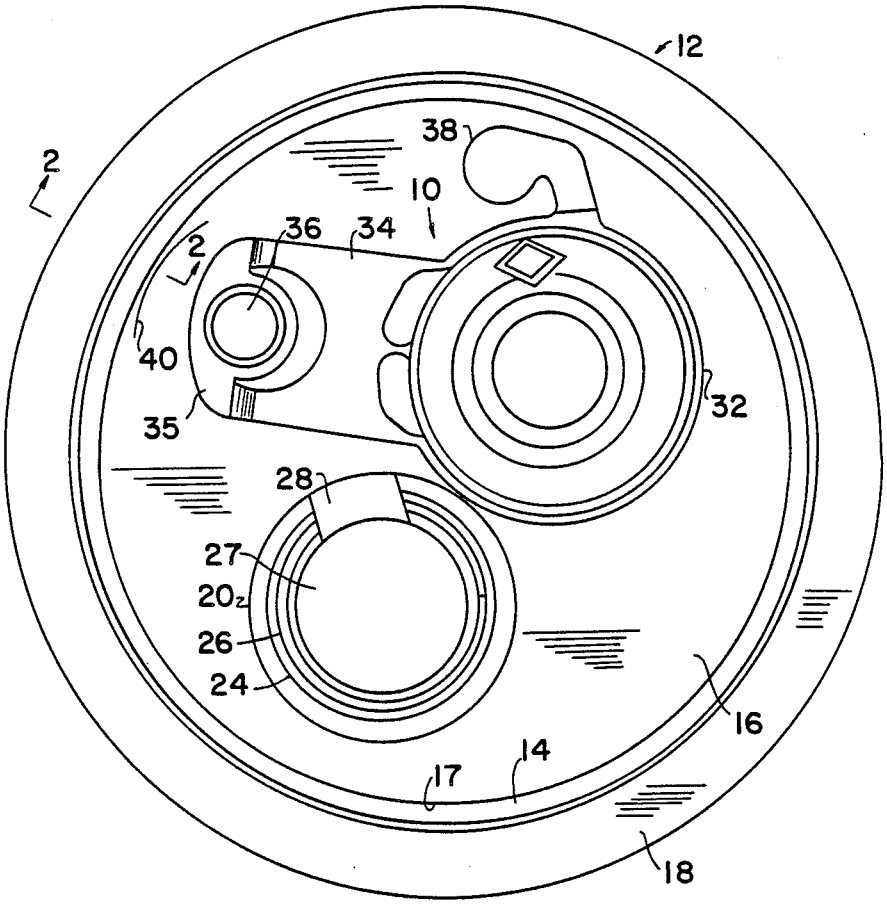
FIG. 1 is a plan view of a pressure relief venting system incorporating the principles of this invention as included on a resealable open end can end construction of the type generally disclosed in U.S. Pat. No. 4,580,692.

As pointed out above, the invention will be described in association with a resealable easy open end construction of the type generally disclosed in U.S. Pat. No. 4,580,692, the disclosure contents of which are incorporated by reference. However, it should be understood that the invention may be used in other easy open end can constructions.

Where the words "upwardly", "inwardly", "outwardly", "under", and the like are used hereinafter, their meaning is to be taken with reference to a can in an upright position having a can end incorporating this invention attached to the top end thereof.

Referring to the drawings, an internal pressure responsive venting system incorporating the principles of this invention is disclosed in association with a can end closure 12 prior to the can end closure's engagement with a can body by double seaming. Such can end closure 12 includes a substantially flat or planar end wall portion 16, a countersink defining inner sidewall 17 and an outer sidewall 14 terminating in an upwardly and outwardly projecting annular flange 18 forming a chime for conventional attachment of the can end to a can body by double seaming.

The can end closure 12 further includes an upwardly projecting dispensing spout 20, suitably of circular configuration and formed as an integral portion thereof. Such spout 20 includes an inclined top wall 24 having a score line 26, interrupted by a hinge 28, partially circumscribing and defining an opening panel 27 depressible inwardly of the can by fracture of the score line. Associated with the dispensing spout 20 is a resealing cap assembly 10, preferably molded in one piece of a resinous or plastic material having a low modulus of elasticity, such as, for example, low density polyethylene. The resealing cap assembly 10 includes a sealing cap portion 32 adapted to be placed in sealing relation over the spout 20 and the score line defined opening panel 27 therein, and a tab 38 projecting outwardly from the sealing cap portion 32 for convenience in manipulation of the cap. The cap assembly 10 is pivotally attached to the end wall 16 by means of a rivet 36 extending through an appropriate opening in a boss 35. The outboard edge of the flange of the rivet 36 is formed downwardly a controlled amount when the rivet is staked to securely attach the cap to the can end, yet still permit the sealing cap portion 32 to be rotated by hand about the rivet 36 with relative ease. Preferably, the rivet 36 is an integrally formed portion of the end wall 16.

As pointed out earlier, experience to date as shown that failure of the above-described resealable easy open end construction due to excessive internal pressure usually occurs because of rupture of the score line defining the opening panel 27, in contradistinction to conventional easy open end constructions where the opening panel score line usually remains intact and the can end ruptures at the countersink when the countersink inverts.

Figure 2:
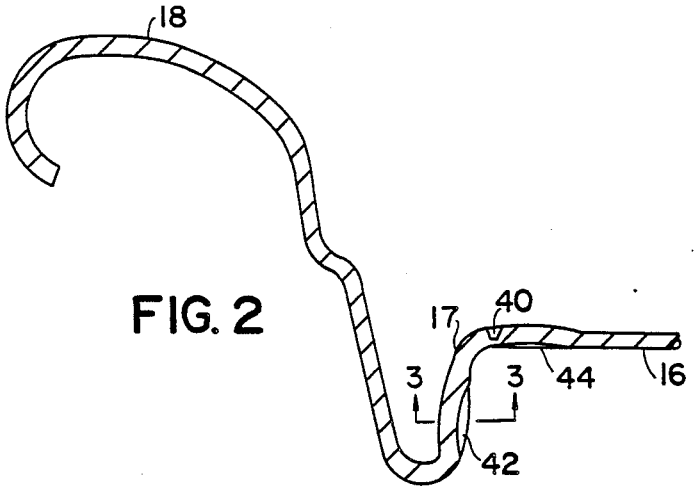
FIG. 2 is a section as taken on the line 2—2 in FIG. 1.
Figure 3:
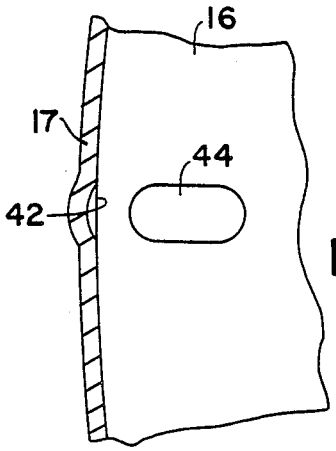
FIG. 3 is a section as taken on the line 3—3 of FIG. 2.

In order to insure against rupture of the score line 26 defining the opening panel, a short score line 40 defining a deformation inducible fracture line is provided in the end wall portion 16 remote from the spout 20 and located closely adjacent to the inner countersink defining wall 17. The short score line 40 is preferably in the form of an arc of a circle centered on the radius of the can end 12 that passes through the center of the rivet and located in the area outboard of the rivet 36 and inboard of the inner countersink wall 17 and subtending a sector of about 50 to 70 degrees, suitably about 64 degrees. Disposed adjacent to said score line 40 is a shallow outwardly directed buckle inducing indentation 42 in the inner surface of the countersink defining wall 17. The indentation 42 is preferably disposed in alignment with the radial center line of the arcuate score line 40. Desirably associated therewith is a second upwardly directed shallow buckle inducing indentation 44, suitably of generally oval character, in the underside of said planar end wall portion 16 located closely adjacent to the score line 40 and again preferably disposed in alignment with the radial center line of the arcuate score line 40. As shown best in FIGS. 2 and 3, each of the shallow indentations 42 and 44 produce a complemental bulge on the outer surface of the countersink defining wall 17 and upper surface of the planar wall portion 16 respectively.

Figure 5:
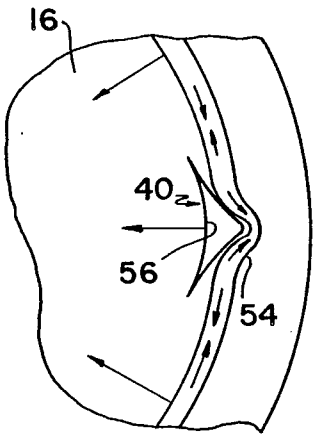
FIG. 5 is an enlarged representation of the stress pattern resulting from excessive internal pressure that is operative to activate the venting means incorporated in a can end wall in accord with the principles of this invention.
Figure 4:
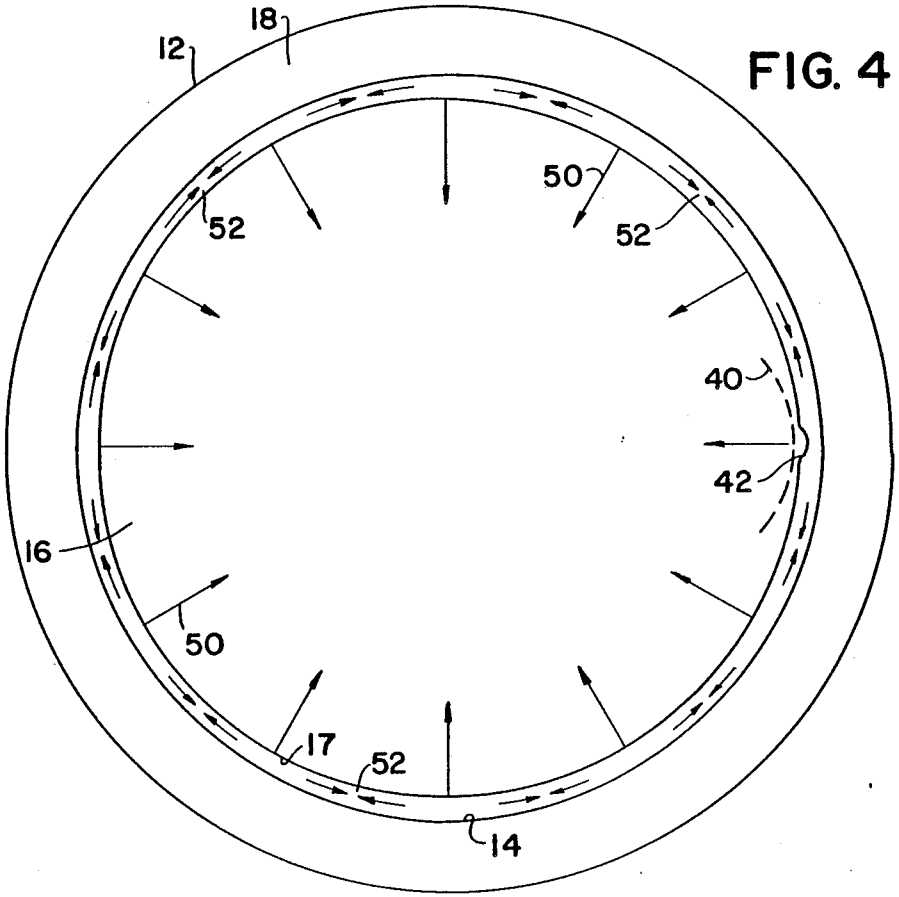
FIG. 4 is a schematic representation of the stress pattern in the countersink portion of a can end incorporating the principles of this invention.

In the operation of the above-described structure as schematically depicted in FIGS. 4 and 5, increases in internal pressure within the container produce increases in radial tension stresses, as indicated by the arrows 50, in the wall portion 16 and concomitant increases in hoop compression stresses, as indicated by the arrows 52, in the countersink. The shallow indentation 42 in the inner side of the countersink defining wall 17 locally weakens its resistance to buckling in hoop compression and is operative to selectively induce the formation of a buckle at such location. Such localized buckling, as depicted at 54 in FIG. 5, which will occur at a predetermined internal pressure, dependent at least in part by the depth of indentation 42, will result in a localized initial deformation and concentration of fracture inducing forces at the score line 40. Such forces will result in a fracture of the wall portion 16 at the score line 40, as shown at 56 in FIG. 5, thus providing a pressure responsive safe venting of the internal pressure at a predetermined location remote from the spout 20 in the can top closure element. Safe venting of the internal pressure at a site remote from the spout insures against buckling of countersink adjacent the spout that would tend to promote rupture of score line defining the opening panel.

In a preferred embodiment of the foregoing adapted for use in association with the resealable easy open end construction disclosed in the aforesaid U.S. Pat. No. 4,648,528, the end closure blank is designed to have a countersink buckle resistance substantially higher than the industry standard of 93 psi, suitably in the range of 108–112 psi. Such general increase in countersink buckle resistance not only serves to reduce possible countersink buckling and consequent stress concentration in the vicinity of the spout 20 but also provides the latitude to incorporate the above-described pressure releasing vent system into the closure that will not release below 93 psi but which will release before general countersink buckling can occur, i.e., at pressures in excess of 100 psi.

Information ascertained to date indicates that the above-described venting system can operate within a pressure release range of about 5 psi and has the additional advantage of being tunable to a desired pressure level range. The tuning parameters appear to be the depth of the shallow indentation 42 and to a lesser extent the indentation 44, the depth of the score in score line 40 and the distance of the score line 40 from the countersink. Deeper indentations, deeper scores, and lesser distance between score line and countersink decrease the release or score line fracture pressure and vice versa.

As will now be apparent, the foregoing described venting construction lends itself to being formed on the same equipment and concurrently with the other constructional features of the can end closure and does not interfere with the stacking or feeding of the finished closures in the can making machinery. As is equally apparent, the venting or failure mode is simply an opening of the score line 40 with a consequent release of internal pressure and creates neither a real nor perceived safety hazard.

Having thus described my invention, I claim:

1. A sheet metal end closure for a container comprising:

a generally planar wall portion having a peripheral chime for securement to a container body, a peripheral countersink defining wall disposed immediately inward of said peripheral chime, an integral, score line defined, opening panel, a second score line defining a deformation inducible fracture line disposed in closely spaced adjacent relation with a portion of said countersink defining wall, and a shallow outwardly directed buckle inducing indentation in said countersink defining wall located adjacent to said second score line to promote initiation of pressure induced buckling of said countersink defining wall thereat and a concentration of buckle created fracture inducing forces at said second score line.

2. An end closure as set forth in claim 1 wherein said second score line is of arcuate configuration having its center located on a radius of said end closure and wherein approximately half the arcuate length of said second score line lies on either side of said radius of said end closure.

3. An end closure as set forth in claim 1 further including a second upwardly projecting shallow buckle inducing indentation in said planar wall portion inwardly of and closely adjacent to said score line.

4. An end closure as set forth in claim 2 wherein said fracture line extends over an arc of about 50 to 70 degrees.

5. An end closure as set forth in claim 1 wherein said second score line is in the shape of an arc of a circle whose center and whose center of arc length lie on a radius of said end closure and said buckle inducing indentation is also located on said radius of said end closure.

6. An end closure as set forth in claim 1 wherein said opening panel is inwardly displaceable and is disposed in non-concentric relation with said peripheral chime.

7. An end closure as set forth in claim 6 wherein said second score line is located remote from said opening panel.

8. A sheet metal end closure for a container comprising:

a generally planar wall portion having a peripheral chime for securement to a container body, a peripheral countersink defining wall disposed immediately inward of said peripheral chime and in substantially perpendicular relation to said planar wall portion, an integral, score line defined, inwardly displaceable relatively rigid opening panel disposed non-concentric with said peripheral chime, an arcuate score line extending over an arc of from about 50 to 70 degrees defining a deformation inducible fracture line disposed in the upper surface of said wall portion in non-concentric closely spaced adjacent relation with a portion of said countersink defining wall located remote from said opening panel therein, a shallow outwardly directed buckle inducing indentation on the inner surface of the countersink defining wall located at the point where said arcuate score line is closest to said countersink, and said buckle inducing indentation operative to promote initiation of pressure induced buckling thereat and a concentration of buckle created fracture inducing forces at said arcuate score line.

9. An end closure as set forth in claim 8 including second upwardly projecting shallow buckle inducing indentation in the underside of said planar wall portion inwardly of and closely adjacent to said arcuate score line.

10. An end closure as set forth in claim 9 wherein said first and second indentations are located in alignment with the radial center line of said arc that lies on a radius of said end closure.

11. In an end closure for a container that includes:

a generally planar wall portion having a peripheral chime for securement to a container body, a peripheral countersink defining wall disposed immediately inward of said peripheral chime and in substantially perpendicular relation to said planar wall portion, an upwardly projecting spout disposed non-concentric with said peripheral chime and including an integral, score line defined, inwardly displaceable opening panel therein, and a resealing cap assembly engageable with said spout assembly including an arm having an end portion attached to said wall portion by a rivet disposed remote from said spout, the improvement comprising:

an arcuate score line defining a deformation inducible fracture line disposed in the upper surface of said wall portion in closely spaced adjacent relation with a portion of said countersink defining wall disposed in the vicinity of said rivet, and a shallow outwardly directed buckle inducing indentation on the inner surface of the countersink defining wall located where said arcuate score line comes closest to countersink to promote initiation of pressure induced buckling of said countersink defining wall thereat and a concentration of buckle created fracture inducing forces at said arcuate score line.

12. The improvement as set forth in claim 11 further including a second upwardly projecting shallow buckle inducing indentation in the undersurface of said planar wall portion intermediate said arcuate score line and said rivet.

13. The improvement as set forth in claim 11 wherein said arcuate score line is in the form of an arc of a circle whose center is on the radius of said can end that passes through the center of said rivet and wherein approximately half the length of said arcuate score line lies on either side of said radius.

14. An end closure as set forth in claim 13 wherein said arcuate score line is non-concentric with said countersink defining wall and extends over a sector of about 50 to 70 degrees.

15. An end closure as set forth in claim 13 wherein said buckle inducing indentation is located in proximity with said radius of said can end.

* * * * *